United States Patent [19]

Jones

[11] Patent Number: 4,606,576

[45] Date of Patent: Aug. 19, 1986

[54] TRAY FOR A HIGH CHAIR

[76] Inventor: Richard O. Jones, 1306 Frontera, Millbrae, Calif. 94030

[21] Appl. No.: 732,662

[22] Filed: May 10, 1985

[51] Int. Cl.[4] ..... A47B 39/00

[52] U.S. Cl. ..... 297/153; 108/24; 211/126; 297/148

[58] Field of Search ..... 211/126; 312/351, 242; 434/403, 430, 429, 128; 297/153, 149, 148, 182, 153; 108/24, 28, 27

[56] References Cited

U.S. PATENT DOCUMENTS

| | | | |
|---|---|---|---|
| 491,649 | 2/1893 | Hofmann | 211/126 |
| 1,420,061 | 6/1922 | Rappeline | 108/24 |
| 2,994,557 | 8/1961 | King | 297/153 X |
| 3,023,067 | 2/1962 | Maassen | 312/242 |
| 3,223,940 | 2/1966 | Tooley, Jr. | 108/24 X |
| 3,475,052 | 10/1969 | Kaposi | 297/153 |
| 3,766,668 | 10/1973 | Vogel | 434/403 |
| 4,021,939 | 5/1977 | Mav | 434/403 |

*Primary Examiner*—James T. McCall
*Attorney, Agent, or Firm*—Paul L. Hickman

[57] ABSTRACT

A tray for a high chair characterized by a base receptacle which attaches to the arms of the high chair, and a lattice member which is supported by the walls of the base receptacle. The lattice member, which is provided with indicia of educational and entertainment value, permits spilled food and drink to collect within the base receptacle rather than upon the eating surface. The lattice may also be optionally provided with a fixed and a removable feeding bowl.

17 Claims, 2 Drawing Figures

TRAY FOR A HIGH CHAIR

BACKGROUND OF THE INVENTION

1. Field of the Invention

This invention relates generally to high chairs, and more particularly to the eating tray of high chair.

2. Description of the Prior Art

High chairs have been in use for many years for the feeding of infants, toddlers, and small children. A high chair includes a seat supported by three or four legs, a seat back, a pair of arms on either side of the seat, and a tray attached to the arms of the chair.

Children are not noted for being particularly fastidious diners. A high proportion of their food and drink tends to be distributed over the high chair tray, the floor, and themselves.

The prior art has addressed this problem in several ways. For example, in U.S. Pat. No. 3,729,037 of Dare et al., throwaway disposable paper or plastic covers are disclosed which are formed or molded to conform to the top of a child's high chair tray. Once the cover is soiled, it is removed from the tray and disposed of.

Another approach is taken in U.S. Pat. No. 3,147,036 of McRae. In his patent, McRae teaches a high chair tray having an upwardly extending flange which retains solids and liquids spilled on the tray. The tray is removable for easy cleaning.

Stone in U.S. Pat. No. 2,684,110 teaches a convertible table having a locked-in food dish. The food dish is attached within an aperture provided in the high chair tray with its upper rims substantially flush with the surface of the table. The apparent theory behind Stone's device is that if the dish cannot be removed from the tray, it cannot be dropped or thrown by the child.

A problem with the approaches taken by Dare et al., McRae, and Stone, is that any spillage on the tray remains on the surface of the tray resulting in a messy amalgam which adheres to utensils, tableware, and the child.

A problem that the prior art has not addressed is that of relieving boredom in the young diner. Children typically have a short attention span, and will often amuse themselves by hurling food, spilling liquids, etc. Any device that would relieve this boredom would have the desirable side effect of reducing the mess created by the child.

SUMMARY OF THE INVENTION

An object of this invention is to provide a high chair tray which has an eating surface which is always clean.

Another object of this invention is to provide a high chair tray having a spill proof, but removable, bowl.

Yet another object of this invention is to provide a high chair tray which is easily cleaned after a meal.

A still further object of this invention is to provide a high chair tray which amuses and educates the child as he or she eats.

Briefly, the tray includes a base receptacle having a bottom portion and a contiguous wall portion rising from the edge of the bottom portion, and a rigid lattice supported by an upper section of the wall portion of the base. The base, which is substantially rectangular except that the corners are rounded and one of the edges is recessed to receive the torso of a child, serves as a receptacle for liquids and solids spilled by the child. The rigid lattice is of unitary construction, and includes a grid formed by a plurality of lattice segments attached together at lattice points to form polygonal interstices. Indicia, such as the letters of the alphabet, various geometric designs, and symbols, are attached within the polygonal interstices of the lattice. A removable bowl is also provided which engages a recess provided in the lattice.

An advantage of this invention is that the eating surface (i.e. the top surface of the lattice) is always clean since any food or liquid falls through the interstices of the lattice to the receptacle base below.

Another advantage of this invention is that the child is amused and educated by the great variety of indicia formed within the interstices. Various games can be devised by the parent or the child, and the child has a vested interest in keeping the surface of his high chair tray clean so that such games can be played.

Yet another advantage of this invention is that a removable bowl can be used with the supporting lattice, or the recess itself can be used as a non-removable bowl.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
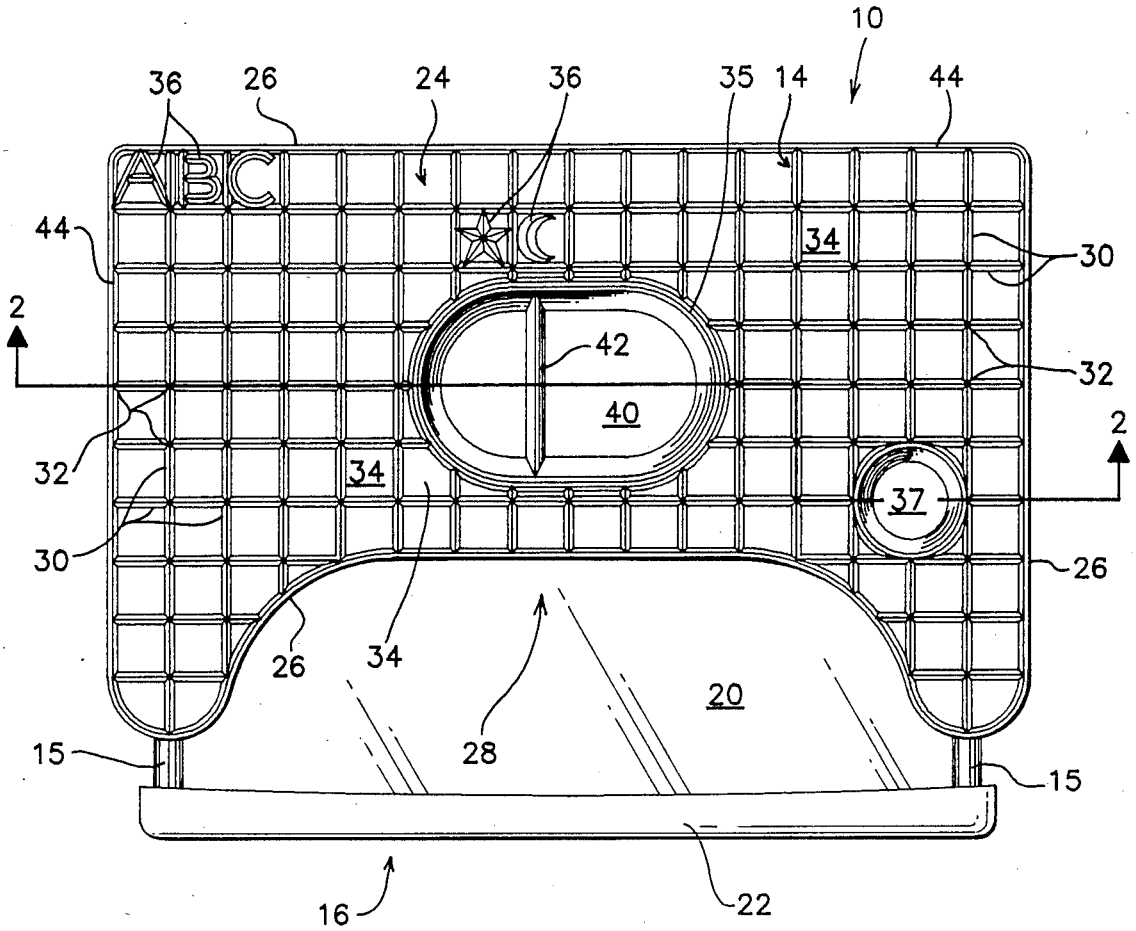
FIG. 1 is a top plan view of a high chair tray in accordance with the present invention.
Figure 2:
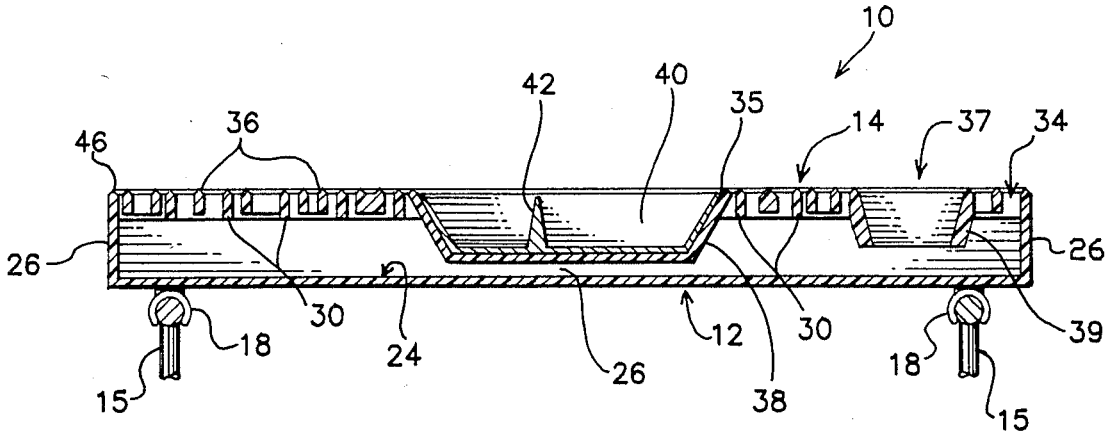
FIG. 2 is a cross sectional view taken along line 2—2 of FIG. 1.

Referring to FIGS. 1 and 2, a high chair tray 10 in accordance with the present invention, includes a base 12, and a lattice member 14 supported by base 12. Base 12 attaches to the arms 15 of a high chair 16 with clips 18. High chair 16 typically includes a seat 20 and a seat back 22.

Base 12 includes a bottom portion 24, and contiguous wall portions 26 extending upwardly from the periphery of bottom portion 24. As best seen in FIG. 1, bottom portion 24 is substantially rectangular in shape, except that it has rounded corners and is provided with an inset portion 28 along one of its longer sides. As previously mentioned, wall portion 26 follows the peripheral contours of bottom portion 24.

Bottom portion 24 and wall portion 26 cooperate to form a leak proof receptacle for solids and liquids. The base 12 can be molded in a single piece from a thermoplastic material, or may alternately be formed by metal bending or other suitable process.

Lattice 14 is a rigid, self supporting member including a plurality of lattice segments 30 joined together at lattice points 32 to form polygonal interstices 34. Disposed within at least some of the polygonal interstices 34 are indicia 36. To prevent breakage, indicia 36 are attached to at least two of the lattice segments. Lattice 14 is preferably molded as a single unit from a thermoplastic material.

Lattice 14 is provided with a centrally located aperture 35 which has a fixed bowl 38 and a removable bowl 40. The removable bowl is preferably provided with a divider 42 so that two food stuffs can be stored within bowl 40 without intermixing. Also, a divider could be provided on fixed bowl 38 which could engage a slot provided in the bottom of divider 42 of a removable bowl 40.

Lattice 14 is also provided with an offset aperture 37 which is surrounded by a tapered, downwardly extending collar 39. A glass or cup may be engaged with aperture 37.

As seen in both FIGS. 1 and 2, the upper surface of lattice segments 30 are preferably beveled so as to minimize the horizontal surface of those members. This reduces the amount of spilled material which would collect upon the upper surface of lattice member 14. Similarly, the upper surfaces of indicia 36 can be likewise beveled to minimize the area of their horizontal surfaces.

Lattice 14 may be provided with an edging 44 which engages an upper section of wall portion 26 to hold the lattice 14 above base 12. Edging 44 engages a shoulder 46 at the upper end of wall 26.

In use, the clips 18 are engaged with the arms 15 of the high chair to firmly attach base 12 of tray 10 to the high chair. Lattice 14 is engaged with the upper section of wall 26, and removable bowl 40 is optionally engaged with fixed bowl 38. Any food or drink spilled by the child will fall through the interstices 34 of lattice 14 and will be collected upon bottom portion 24 of base 12.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A tray for a high chair comprising:

a base having a bottom portion and a contiguous wall portion rising from said bottom portion, said base serving as a receptacle for liquids and solids; and a rigid lattice supported by an upper section of said wall portion of said base, said lattice including a plurality of lattice segments rigidly attached together at lattice points to form polygonal interstices, and indicia members disposed within at least some of said interstices and rigidly attached to at least two lattice segments, wherein an upper surface of at least some of said lattice segments are bevelled to reduce the horizontal surface area of said upper surface of said lattice segments, and wherein at least some of said indicia members have bevelled upper surfaces to reduce the horizontal area of said upper surfaces of said indicia members.

2. A tray as recited in claim 1 wherein said bottom portion of said base is substantially rectangular, except that the corners are rounded and one of the longer edges of said bottom portion has an inset section.

3. A tray as recited in claim 2 wherein said lattice has substantially the same configuration as said bottom portion of said base, and wherein said wall portion follows the periphery of said bottom portion.

4. A tray as recited in claim 3 further comprising a centrally located receptacle suspended by its upper rim above said bottom portion of said base, where said rim substantially flush with an upper surface of said lattice member.

5. A tray as recited in claim 4 wherein said receptacle is removable from said lattice, and wherein said rim engages a suitably configured aperture provided in said lattice.

6. A tray as recited in claim 5 wherein said receptacle is provided with a divider.

7. A tray as recited in claim 4 wherein said rim of said receptacle is formed contiguously with said lattice.

8. A tray as recited in claim 7 wherein said receptacle is provided with a divider.

9. A tray as recited in claim 7 wherein said receptacle is a first receptacle and further comprising a second, removable receptacle similarly configured to said first receptacle and adapted to nestle within said first receptacle.

10. A tray as recited in claim 9 wherein said second receptacle is provided with a divider.

11. A tray as recited in claim 2 further comprising means attached to said base for removably coupling said base to the arms of a high chair.

12. A tray as recited in claim 1 wherein said rigid lattice is provided with an aperture receptive to a glass or 13. A tray as recited in claim 12 further comprising a collar portion surrounding said aperture and extending downwardly from said lattice.

14. A tray as recited in claim 12 wherein said collar portion tapers downwardly.

15. A tray for a high chair comprising:

a base having a bottom portion and a contiguous wall portion rising from said bottom portion, said base serving as a receptacle for liquids and solids; and a rigid lattice supported by an upper section of said wall portion of said base, said lattice including a plurality of lattice segments rigidly attached together at lattice points to form polygonal interstices, and indicia members disposed within at least some of said interstices and rigidly attached to at least two lattice segments.

16. A tray as recited in claim 15 wherein an upper surface of at least some of said lattice segments are bevelled to reduce the horizontal surface area of said upper surface.

17. A tray as recited in claim 15 wherein at least some of said indicia members have bevelled upper surfaces to reduce the horizontal area of said upper surfaces.

* * * * *